US005311706A

United States Patent [19]

Sallee

[11] Patent Number: 5,311,706

[45] Date of Patent: May 17, 1994

[54] INFLATABLE TRUSS FRAME

[75] Inventor: Bradley Sallee, Austin, Tex.

[73] Assignee: Tracor Aerospace, Inc., Austin, Tex.

[21] Appl. No.: 732,810

[22] Filed: Jul. 19, 1991

[51] Int. Cl.[5] ..... E04C 3/28

[52] U.S. Cl. ..... 52/2.18; 52/2.21; 52/693; 52/730.1; 52/DIG. 8

[58] Field of Search ..... 52/2.11, 2.13, 2.18, 52/2.21, DIG. 8, 690, 6912, 693, 694, 730.1, 2.23; 5/449, 452, 456, 458, 458, 474; 128/118.1

[56] References Cited

U.S. PATENT DOCUMENTS

| | | | |
|---|---|---|---|
| 418,660 | 12/1889 | Storrs | 128/118.1 |
| 1,092,928 | 4/1914 | Mastin | 5/449 |
| 1,382,831 | 6/1921 | Hilker | 5/449 |
| 2,318,613 | 5/1943 | Lane | 128/118.1 X |
| 2,672,628 | 3/1954 | Spanel | 5/457 |
| 2,946,337 | 7/1960 | Wolshin . | |
| 3,030,640 | 4/1962 | Gosman . | |
| 3,044,515 | 7/1962 | Eades . | |
| 3,058,122 | 10/1962 | MacDaniel et al. | 5/449 |
| 3,274,596 | 9/1966 | Raabe . | |
| 3,405,886 | 10/1968 | Gosnell et al. . | |
| 3,457,684 | 7/1969 | Wood, Jr. . | |
| 3,496,730 | 2/1970 | Tsuji . | |
| 3,742,658 | 7/1973 | Meyer . | |
| 3,779,847 | 12/1973 | Turner . | |
| 3,830,519 | 8/1974 | Lewis | 5/449 X |
| 3,918,518 | 11/1975 | James . | |
| 3,970,328 | 7/1976 | Wallsten . | |
| 4,065,888 | 1/1978 | Napierski . | |
| 4,309,851 | 1/1982 | Flagg | 52/2.21 |
| 4,335,545 | 6/1982 | Couch . | |
| 4,340,626 | 7/1982 | Rudy . | |
| 4,567,887 | 2/1986 | Couch, Jr. | 128/118.1 X |
| 4,643,210 | 2/1987 | Feld . | |
| 4,807,405 | 9/1989 | Borgquist | 52/2.18 |
| 4,856,228 | 8/1989 | Robinson, Sr. . | |
| 4,876,829 | 10/1989 | Mattick | 52/2.18 X |
| 4,959,901 | 10/1990 | Parish | 52/2.18 |
| 5,007,212 | 4/1991 | Fritts et al. | 52/2.18 |
| 5,044,579 | 9/1991 | Bernasconi et al. | 52/2.18 X |

FOREIGN PATENT DOCUMENTS

| | | | |
|---|---|---|---|
| 273870 | 6/1988 | European Pat. Off. . | |
| 14957 | of 1895 | United Kingdom . | |
| 2177737 | 1/1987 | United Kingdom | 52/2.18 |

*Primary Examiner*—Carl D. Friedman
*Assistant Examiner*—Robert J. Canfield
*Attorney, Agent, or Firm*—Arnold, White & Durkee

[57] ABSTRACT

An inflatable truss frame member for use in the frame of a large inflatable device such as a ship or satellite decoy. A first embodiment, developed for use in satellite decoys, comprises three main inflatable tubes separated by shear load carrying interlacing inflatable tubes. The first embodiment may be manufactured by laminating two MYLAR sheets together using a triangular pattern of adhesive print to form a series of inflatable tubes. Excess material is removed from between the tubes and the edges of the MYLAR are bonded together forming a cylinder to complete the inflatable truss frame member. A second embodiment, developed for the heavier shear loading of ship decoys, comprises three main inflatable tubes separated by a shear load carrying web. The second embodiment may be manufactured by bonding an inner and outer tube made of MYLAR along arcuately spaced strips. The bonded MYLAR forms the separating web and unbonded MYLAR forms three inflatable tubes. Alternately, the second embodiment may be manufactured by separately forming three inflatable tubes and then bonding the separating web material to the inflatable tubes. Rigid stays or battens may be added between the three inflatable tubes when the separating web will not be strong enough to support the shear loading.

5 Claims, 3 Drawing Sheets

INFLATABLE TRUSS FRAME

BACKGROUND OF THE INVENTION

1. Field of the Invention

This invention concerns large, lightweight, inflatable structures such as satellite decoys and ship decoys. More particularly, this invention relates to inflatable tubes used as supports in such structures.

2. Description of the Prior Art

Large, lightweight, inflatable structures find various applications. Generally speaking, these devices need structural members as reinforcement. Conventional ship decoys or satellite decoys are large, inflatable structures which typically employ internal inflatable tube frames for structural support.

The sizing of the tubes in such a tube frame is determined, at least in part, by the cross sectional area moment of inertia. In other words, a tube size is conventionally chosen to prevent the tubes from buckling and thereby keeping the decoy from collapsing under its own weight.

With a large cross section, a tube in a tube frame requires a large gas volume to inflate. Using tubes, particularly with a large cross section, also increases the weight of the entire decoy due to the weight of material required to construct the inflatable device and the gas required for inflation.

A typical satellite decoy is fabricated and packaged in a canister along with gas required to inflate the decoy. The decoy is packaged in a canister to conserve space on the launch vehicle for other cargo. For the satellite decoy, the weight and volume of the deflated satellite decoy as well as the weight and volume of inflation gas are crucial in reducing launch costs.

Advances in inflatable devices have enabled easier inflation of devices such as air-mattresses or tents, but at the expense of added material weight. For instance, U.S. Pat. No. 4,065,888 issued to Napierski, incorporated herein by reference, describes an inflatable device which reduces the effort required to pump up the device. The Napierski device uses two air inlet valves, valves a, and b. Valve a is used to blow up an outer shell, tube frame or skeleton which requires a relatively limited air volume to give structure to the overall device. Upon inflation through valve a, air is simultaneously drawn through valve b to fill the remainder of the inflatable device which has a much larger air volume. Thus, a reduced effort is required to complete pumping the inflatable tube through valve b. FIGS. 6 and 7 of Napierski show a tent with inflatable support props which require a relatively large air volume to inflate, however, by using inflatable skeletons inflated by separate valves, pump-up time for the full support prop is reduced.

Advances have also been made in manufacturing techniques for inflatable devices. U.S. Pat. No. 3,742,658 issued to Meyer, incorporated herein by reference, shows a geodesic structure which is formed by sealing two sheets of flexible material together with the sealing lines disposed in a triangular pattern to form a series of inflatable tubes. Excess edge material is severed away from the edges of the flexible material, and the edges are then joined to complete the inflatable geodesic structure. Meyer refers to the tubular edges as edge struts.

SUMMARY OF THE INVENTION

Use of the present invention in the frame of an inflatable structure may reduce the weight of the structure and its required inflation gas as much as five times over prior art structures. The invention may reduce material weight even more than five times over a structure such as shown by Napierski which requires an internal inflatable device as well as the original inflatable structure.

The present invention achieves the reduction in weight and inflation gas by using inflatable truss-type frame members instead of tube-type frame members. The inflatable truss-type frame members preferably include three elongated, inflatable members which are braced or stiffened, as for example, by smaller inflatable interlacing members, or an interconnecting web of film. Expressed otherwise, a plurality of elongated members are trussed together in a generally parallel, spaced relation.

The present invention has particular application in the construction of ship and satellite decoys where large inflatable tubes make up their frame. A first embodiment of the present invention has particular application in space, while a second embodiment has particular application in the atmosphere.

A first embodiment of an inflatable truss-type member, developed for use in satellites decoy, uses three main inflatable tubes separated by shear load carrying interlacing inflatable tubes. Interlacing inflatable tubes are used because of the lighter shear loads in space.

A second embodiment of an inflatable truss-type member, developed for use in ship decoys, uses three main inflatable tubes separated by a shear load carrying web. The shear load carrying web is used because of larger shear loads in the atmosphere. Rigid stays or battens may be added between the three inflatable tubes when the load carrying web is not strong enough to support the shear loading.

The present invention also includes methods of manufacturing the inflatable truss-type frame members of the present invention.

The first embodiment is manufactured by laminating two sheets of a polyester film sold under the trademark "MYLAR" by E. I. Du Pont De Nemours and Co. or other suitable material together using a triangular patterned adhesive print to form a series of inflatable tubes. Excess material is removed from between the tubes and the edges of the MYLAR are bonded together forming a cylinder. Ends of the tubes are then sealed except for one opening which serves as a valve for inflation.

The second embodiment is manufactured by bonding an inner and outer tube made of MYLAR along arcuately spaced longitudinal strips. Bonded MYLAR forms a separating web and unbonded MYLAR forms a plurality of tubes. One end of the tubes may then be sealed and the other end used as a valve for their inflation.

Alternately, the second embodiment may be manufactured by separately forming the plurality of inflatable tubes and then bonding the separating web material to the inflatable tubes.

BRIEF DESCRIPTION OF THE DRAWINGS

Further details of the present invention are explained with the help of the attached drawings in which.

DESCRIPTION OF THE PREFERRED EMBODIMENTS

Figure 1:
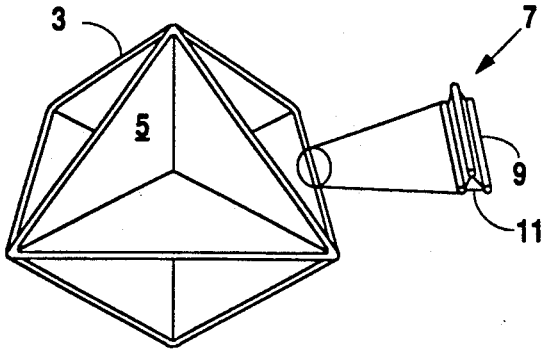
FIG. 1 shows a perspective view of a satellite with an inflatable framework comprising inflatable frame members of the present invention, and includes a blow-up perspective view of a portion of a frame member.

FIG. 1 shows a typical satellite decoy with structural support provided by inflatable frame members 3. The inflatable frame members 3 of the satellite decoy are used to support radar corner reflector panels 5. In the past, the inflatable frame members 3 have been simple, inflatable tubes. The sizing of the inflatable tubes has been driven by the cross sectional moment of inertia. In other words, the tubes must be large enough to prevent a decoy from collapsing under its own internal loading. Additionally, the material making up the tube must be air tight and have sufficient strength to withstand the gas pressure within. In simple tubes, this leads to heavy penalties in gas weight and to a lesser extent tube weight.

By changing the simple tubes into truss structures with three external tubes spaced apart by load carrying members, the volume of inflation gas required drops drastically. Material weight and package volume are also reduced. The savings of weight and volume relative to simple tubes is accomplished by increasing the area moment of inertia of the beams by using multiple tubes at higher pressure, thus lowering the gas weight needed and increasing the effective use of the inflatable material. As mentioned earlier, the use of an inflatable truss-type frame member in space may typically provide material and gas weight savings as much as five times over a simple tube.

With an inflatable truss-type frame member used in air, the loads are typically much higher per unit length. The load handling capability of the gas within a tube in the atmosphere is also reduced, because considerable gas weight overhead is required to fill a tube to atmospheric pressure before pressurization can start. In air inflatables, the gas weight savings of a truss over a single tube is typically five times, resulting in an overall weight savings of two times or more.

FIG. 1 shows how inflatable frame members 3 may be used to form the framework of a satellite decoy. The blow up portion 7 shows an inflatable frame member consisting of an inflatable truss of the present invention. The inflatable truss is composed of three small tubes 9 separated by supporting material 11. The inflatable truss is used in place of the inflatable tubes of the prior art.

Two embodiments of an inflatable truss-type frame member of the present invention, and a manufacturing technique for each embodiment, are described below.

Figure 2:
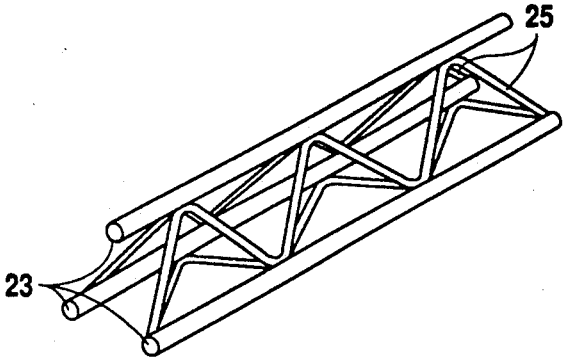
FIG. 2 shows a first embodiment of an inflatable truss of the present invention.

FIG. 2 shows a first embodiment of an inflatable truss of the present invention. The first embodiment includes three main inflatable tubes 23. The three main inflatable tubes 23 are separated by inflatable interlacing tubes 25. The interlacing tubes 25 provide shear loading support.

Figure 3A:
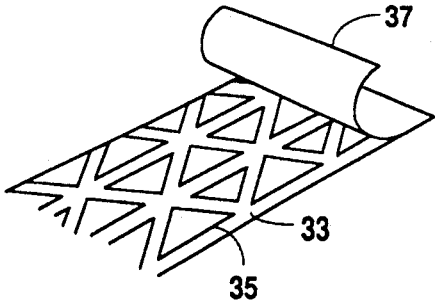
FIGS. 3A-3C show the manufacturing steps for a segment of the inflatable truss of FIG. 2.
Figure 3B:
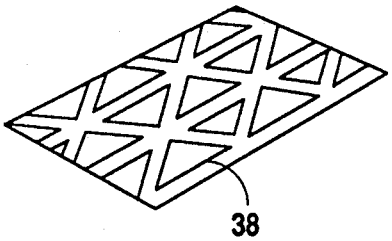
Figure 3C:
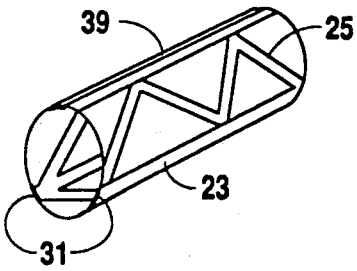

FIGS. 3A-3C show a sequence of manufacturing steps for the inflatable truss of FIG. 2. In step 1, triangular lines of adhesive print 35 are deposited on a bottom layer of MYLAR film 33. A top layer of MYLAR film 37 is then laminated or bonded to the bottom layer 33 by the adhesive print 35. In step 2, excess MYLAR 38 is cut out from between the truss tubes leaving only the inflatable tubes remaining. In step 3, the edges of the MYLAR film are bonded into a cylinder along seam 39. The triangular pattern of adhesive print bonds to the MYLAR sheets to form the three main tubes 23 as well as the interlacing tubes 25. Open ends 31 of the three main inflatable tubes can now be sealed, except for one open end which can be used as a valve for inflation. Alternately, a valve can be inserted in the one open end for inflation. The three main inflatable tubes and the interlacing tubes are all interconnected and may be inflated through a single valve.

Figure 4:
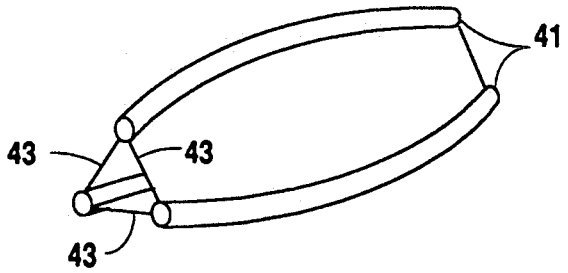
FIG. 4 shows a second embodiment of an inflatable truss of the present invention.

FIG. 4 shows a second embodiment of an inflatable truss of the present invention. The second embodiment has three main inflatable tubes 41 just as in the first embodiment. The three main inflatable tubes 41 are separated by a web material 43. The tubes 41 are bowed to keep the web material 43 in tension. The web material 43 provides shear loading support.

Figure 5A:
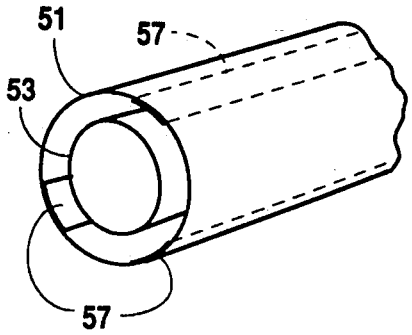
FIGS. 5A and 5B show the manufacturing steps for the inflatable truss of FIG. 4.
Figure 5B:
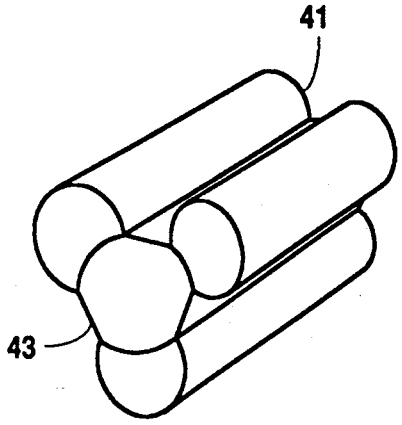

FIGS. 5A and 5B show a sequence of manufacturing steps for the inflatable truss of FIG. 4. In step 1, an outer tube 51 is coated internally with longitudinal strips of adhesive bond material 57 and an inner tube 53 is inserted into the outer tube 51. Both the inner tube 53 and outer tube 51 may be made from MYLAR. In step 2, the outer tube 51 is bonded to the inner tube 53 by the strips of bond material 57. The longitudinally bonded strips of the tubes form the separating webs of material 43, and the unbonded portions form the three main tubes 41. One end 45 of the three main tubes 41 can now be sealed on one side and the remaining open ends 45 can be used as valves for inflation. Alternately, valves may be inserted in the remaining open ends for inflation of the three main tubes.

Figure 6:
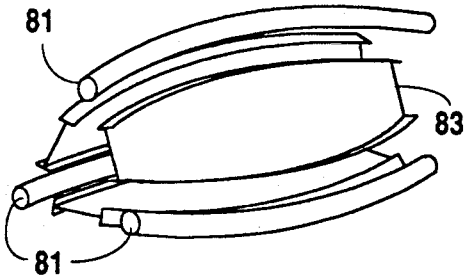
FIG. 6 is an exploded view showing an alternate manufacturing technique for the inflatable truss of FIG. 4.

FIG. 6 is an exploded view showing an alternate manufacturing technique for the inflatable truss of FIG. 4. With this manufacturing technique, the inflatable tubes 81 are separately manufactured. Web material 83 with an H shaped cross section is then bonded to the inflatable tubes 81 to form the inflatable truss member of FIG. 4.

Figure 7:
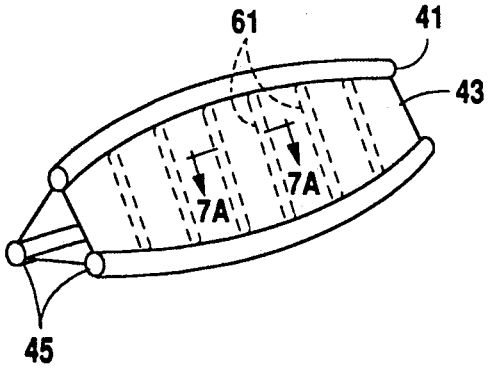
FIG. 7 shows insertion of rigid stays or battens to hold shear loads which the shear web will not alone support.

FIG. 7 shows insertion of rigid stays or battens 61 between the three main inflatable tubes 41 of the embodiment of FIG. 4. The rigid stays or battens 61 have radiused ends rather than pointed edges to prevent the stays from puncturing the inflatable tubes.

The stays can be made from materials such as stainless steel sheet metal, or plastic with a thickness of approximately 0.001 in. For a typical truss member 14 ft. bts in length with tube diameter of 1 in. and tube spacing of 8 in., the stays used are 3/8 in. wide and spaced 1.3 in.

center to center. Such a truss can carry a compression load of approximately 350 lb.

Figure 7A:
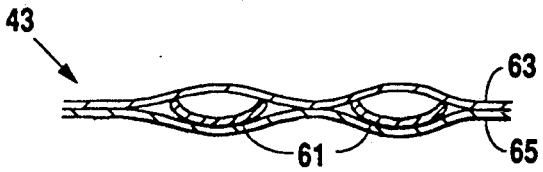
FIG. 7A is a cross sectional view from FIG. 6 showing detail of the rigid stays or battens.

FIG. 7A is a cross sectional view from FIG. 7 showing detail of the rigid stays or battens. As shown in FIG. 7A, the web material 43 can be formed by laminating rigid stays or battens 6 between the outside material layer 63 and inside material layer 65. Also, as shown in FIG. 7A, the rigid stays or battens 61 are preferably C shaped. The C shaped cross section of the stays allows the stays to flatten during folding for better packaging.

As noted previously, the first embodiment of FIG. 2, using inflatable interlacing tubes 25, is designed especially for use in space in satellite decoys because less inflation pressure and load carrying capabilities are required. Since the three main tubes and interlacing tubes are interconnected and may be inflated using a single valve, the internal inflation pressure which the truss can withstand without leaking is less than individually inflatable tubes. The interlacing tubes also may not carry the shear loading of the second embodiment, particularly with the rigid stays or battens added as shown in FIG. 7.

The second embodiment shown in FIG. 4 is considered more adaptable to ship decoys used in the earth's atmosphere, because of the increased inflation pressure which the three individually inflatable tubes will hold. The second embodiment, particularly with rigid stays or battens as shown in FIG. 7, is capable of supporting large shear loads. The earth's atmosphere which has atmospheric pressure and winds as well as gravitational forces applies substantially more shear loading than in space.

The inflatable truss-type members are preferably as light weight as possible. Thus, in the case of space, or exatmospheric structures where the loads are typically small, MYLAR is an especially suitable material of construction because of its strength, light weight and low permeability.

Figure 8:
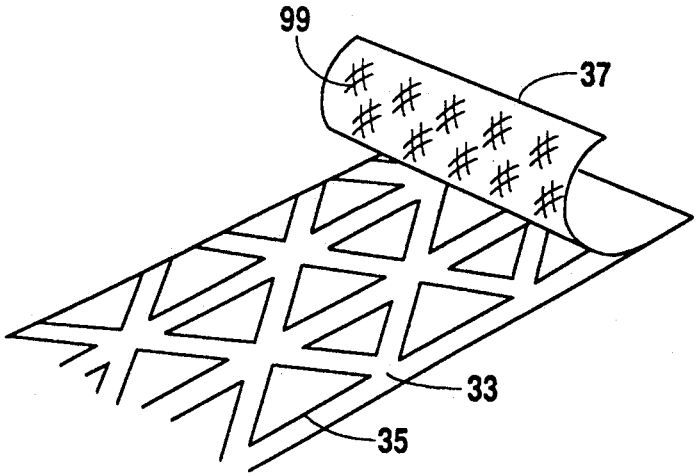
FIG. 8 shows a manufacturing step for a segment of the inflatable truss of FIG. 2, where a reinforcement fiber scrim is bonded onto the surface of the MYLAR to provide reinforcement.

Mylar is also a preferred material of construction for atmospheric, or in air, inflatable truss structures, but with the addition of a reinforcement fiber scrim for higher load carrying capability. Scrim (99 on FIG. 8) is a woven fabric with a widely spaced weave bonded onto the surface of the MYLAR (37) to provide reinforcement. The scrim is made of polyester or an aramid fiber sold under the trademark "KEVLAR" by E. I. Du Pont De Nemours and Co. to increase strength.

Figure 9:
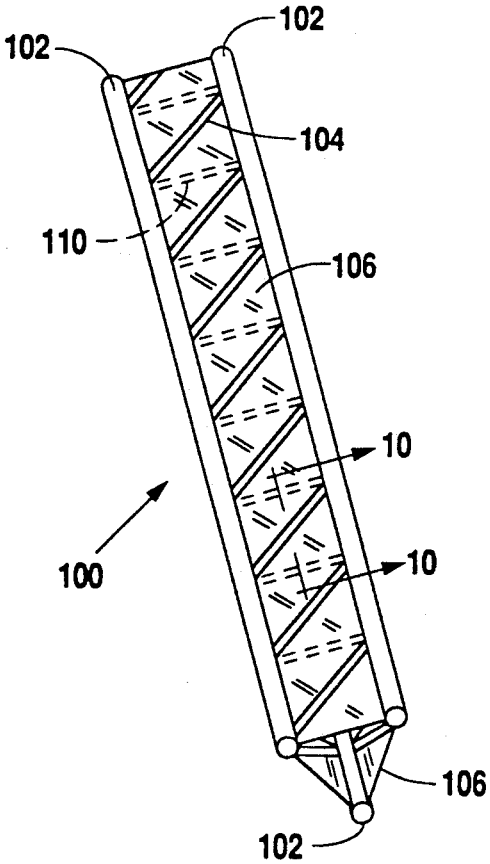
FIG. 9 shows a perspective view of a frame member constructed in accordance with the present invention.
Figure 10:
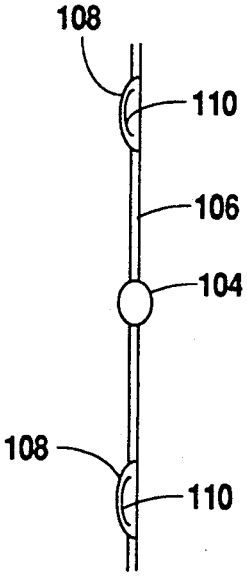
FIG. 10 shows a cross-sectional view of the embodiment shown in FIG. 9 along section line 10—10.

FIG. 9 illustrates a preferred embodiment of the present invention. FIG. 10 is a longitudinal cross section of a portion of FIG. 9, shown as section 10—10 in FIG. 9. Frame member 100 comprises a plurality of elongated, generally parallel inflatable tubes 102, separated by shear load carrying interlacing inflatable tubes 104. Parallel tubes 102 and interlacing tubes 104 are interconnected by a web material 106. Rigid stays 110 may be inserted into pockets 108 formed in interconnecting material 106.

The invention has been described above with particularity, to teach one of ordinary skill in the art how to make and use the invention. Many modifications will fall within the scope of the invention, as that scope is defined by the following claims.

What is claimed is:

1. A frame member for use in an inflatable tube support frame comprising:

an inflatable truss, said truss comprising a plurality of elongated inflatable tubes, trussed together in a generally parallel spaced relation, and separated by shear load carrying interlacing inflatable tubes;

means for interconnecting the parallel inflatable tubes and the interlacing inflatable tubes, the means comprising a web material; and rigid stays inserted between the parallel inflatable tubes.

2. The frame member of claim 1 wherein the rigid stays are C shaped in cross section.

3. A frame member for use in an inflatable tube support frame comprising:

an inflatable truss, said inflatable truss comprising a plurality of substantially parallel inflatable tubes;

means for interconnecting said parallel inflatable tubes, said means comprising a web material; and rigid stays inserted between the parallel inflatable tubes.

4. The frame member of claim 3 wherein the rigid stays are C shaped in cross section.

5. An inflatable truss comprising:

three main inflatable tubes, said tubes being bowed;

web material separating said inflatable tubes, said material being kept in tension by said inflatable tubes; and rigid stays inserted between said three main inflatable tubes.

* * * * *